US011370463B2

(12) United States Patent
Liu et al.

(10) Patent No.: US 11,370,463 B2
(45) Date of Patent: Jun. 28, 2022

(54) ROOF SEGMENTS FOR THE ROOF OF A CARRIAGE BODY

(71) Applicants: CRRC QINGDAO SIFANG CO., LTD., Shandong (CN); CG RAIL—CHINESISCH-DEUTSCHES FORSCHUNGS-UND ENTWICKLUNGSZENTRUM FÜR BAHN-UND VERKEHRSTECHNIK DRESDEN GMBH, Dresden (DE)

(72) Inventors: Shaoqing Liu, Shandong (CN); Zhicheng Guo, Shandong (CN); Zhengyu Song, Shandong (CN); Dongyuan Liu, Shandong (CN); Jiajie He, Shandong (CN); Qinshu Tu, Shandong (CN); Werner Hufenbach, Dresden (DE); Andreas Ulbricht, Dresden (DE)

(73) Assignees: CRRC QINGDAO SIFANG CO., LTD., Shandong (CN); CG RAIL—CHINESISCH-DEUTSCHES FORSCHUNGS—UND ENTWICKLUNGSZENTRUM FÜR BAHN—UND VERKEHRSTECHNIK DRESDEN GMBH, Dresden (DE)

( * ) Notice: Subject to any disclaimer, the term of this patent is extended or adjusted under 35 U.S.C. 154(b) by 337 days.

(21) Appl. No.: 16/484,627

(22) PCT Filed: Feb. 8, 2018

(86) PCT No.: PCT/EP2018/053217
§ 371 (c)(1),
(2) Date: Aug. 8, 2019

(87) PCT Pub. No.: WO2018/146219
PCT Pub. Date: Aug. 16, 2018

(65) Prior Publication Data

US 2021/0331718 A1 Oct. 28, 2021

(30) Foreign Application Priority Data

Feb. 9, 2017 (DE) ..... 10 2017 102 564.2

(51) Int. Cl.
*B61D 17/12* (2006.01)
*B61D 17/00* (2006.01)
(Continued)

(52) U.S. Cl.
CPC ..... *B61D 17/12* (2013.01); *B61D 17/005* (2013.01); *B61D 17/045* (2013.01); *B61D 17/24* (2013.01); *B61D 27/0018* (2013.01)

(58) Field of Classification Search
CPC ..... B61D 17/12; B61D 17/005; B61D 17/24; B61D 27/0018; B61D 17/00; B61D 17/08;
(Continued)

(56) References Cited

U.S. PATENT DOCUMENTS 5,274,979 A * 1/1994 Tsai ..... E04C 2/292 52/588.1
5,988,074 A * 11/1999 Thoman ..... B61D 17/005 105/404
(Continued)

FOREIGN PATENT DOCUMENTS

CN 1111580 A 11/1995
CN 1330597 A 1/2002
(Continued)

OTHER PUBLICATIONS

International Search Report for PCT/EP2018/053217 dated May 4, 2018, ISA/CN.
(Continued)

*Primary Examiner* — S. Joseph Morano
*Assistant Examiner* — Cheng Lin
(74) *Attorney, Agent, or Firm* — Yue (Robert) Xu; Apex Attorneys at Law, LLP

(57) ABSTRACT

The application relates to roof segments for constructing a roof of a carriage body for a rail vehicle for passenger
(Continued)

transport, in particular for use in short-haul operation, such as underground and suburban trains, the rail vehicles or the train units formed by same must be accelerated and decelerated at short intervals. The roof segments are designed in the form of plates, shells or half-shells and consist of an outer wall and an inner wall at a distance to same. At least two roof segments are configured in such a way that the protruding region of the outer wall or inner wall of one roof segment is interlockingly, force-lockingly and/or integrally connected to the non-protruding region of the outer wall or inner wall of the neighbouring roof segment. The roof segments consist at least partially of a fibre-reinforced plastic composite.

15 Claims, 4 Drawing Sheets

(51) Int. Cl.
*B61D 17/24* (2006.01)
*B61D 27/00* (2006.01)
*B61D 17/04* (2006.01)

(58) Field of Classification Search
CPC ..... B61D 17/16; B61D 17/18; B61D 49/00; B61D 17/045; B61D 27/00; B61D 17/043; B61D 17/04
See application file for complete search history.

(56) References Cited

U.S. PATENT DOCUMENTS

| | | | | |
|---|---|---|---|---|
| 6,227,125 | B1 * | 5/2001 | Schroeder | B61D 17/08 105/401 |
| 6,871,600 | B2 * | 3/2005 | Norton | B61D 17/005 105/404 |
| 6,904,848 | B2 * | 6/2005 | Norton | B61D 17/005 105/404 |
| 8,025,331 | B2 * | 9/2011 | Ehrlich | B62D 33/046 296/185.1 |
| 2002/0148382 | A1 | 10/2002 | Norton et al. | |
| 2007/0227396 | A1 * | 10/2007 | Nakamura | B61D 17/12 105/396 |
| 2016/0207547 | A1 * | 7/2016 | Valverde | B61F 1/00 |
| 2019/0389494 | A1 * | 12/2019 | Ding | B61D 17/005 |

FOREIGN PATENT DOCUMENTS

| | | | | |
|---|---|---|---|---|
| CN | 2839055 | Y | 11/2006 | |
| CN | 101045456 | A | 10/2007 | |
| DE | 19619212 | A1 | 11/1997 | |
| DE | 102009045202 | B4 | 9/2014 | |
| EP | 0489294 | A1 | 6/1992 | |
| EP | 0672567 | A1 | 9/1995 | |
| EP | 1138567 | A2 * | 10/2001 | B62D 29/045 |
| EP | 1138567 | A2 | 10/2001 | |
| GB | 2030934 | A | 4/1980 | |
| JP | H0520968 | U | 3/1993 | |
| JP | 2002523287 | A | 7/2002 | |
| JP | 2004122962 | A | 4/2004 | |
| JP | 2016530152 | A | 9/2016 | |
| WO | 0010859 | A1 | 3/2000 | |
| WO | 2016135092 | A1 | 9/2016 | |

OTHER PUBLICATIONS

Second Office Action dated Dec. 11, 2020 for Chinese patent application No. 201880010484.4, English translation provided by Unitalen.

First Office Action dated Aug. 31, 2020 for Japanese patent application No. 2019-543115, English translation provided by Global Dossier.

First Office Action dated Jun. 2, 2020 for Chinese patent application No. 201880010484.4, English translation provided by Global Dossier.

* cited by examiner

ROOF SEGMENTS FOR THE ROOF OF A CARRIAGE BODY

This application is a National Phase entry of PCT Application No. PCT/EP2018/053217, filed on Feb. 8, 2018, which claims the priority of German patent application No. DE 10 2017 102 564.2 filed on Feb. 9, 2017, the entire disclosures of the applications are incorporated herein by reference.

FIELD

The invention relates to the roof segments of a coach body, wherein several roof segments form the roof of the coach body and are used for a rail vehicle for transporting passengers, in particular for use in short distance operation, such as in underground and suburban railways, in which the rail vehicles or the train units formed of them need to be speeded up and slowed down at short intervals.

BACKGROUND

Known coach bodies of rail vehicles, in a conventional design, consist of a tubular construction with two end walls which as a rule are formed as a transition to an adjacent coach body. Alternatively, the end wall can also be formed as a driver's cab.

In a conventional design, the coach body consists of an underframe (also called undercarriage), two side walls and a roof. The assemblies, in particular the side walls and the roof, have a load-bearing, skeleton-like supporting structure, in which lightweight steel profiles are connected to each other or to a thin metal sheet which forms the outer cladding using known welding processes.

For the supporting structure and the cladding, in addition to steel and lightweight steel profiles and thin metal sheets, lightweight and corrosion-resistant materials made of aluminium or aluminium alloys are increasingly being used. Here, the aluminium is built in as a chamber profile to provide greater stability. However, aluminium components are also susceptible to corrosion if they are installed incorrectly.

Disadvantages of this differential design are the high outlay for the manufacture of the elements of the supporting structure and the cladding, and the high susceptibility to corrosion due to the positive-locking or material-bonded connection of the steel or lightweight steel components to each other or to other materials. Thus, the formation of condensation in particular in the area of the window and door apertures results in severe corrosion in the side walls with the result that the load-bearing assemblies in the area of the side walls and in the transition area between roof and side wall regularly have to be replaced after approx. 15 to 17 years.

In addition to the conventional skeleton-type design, efforts have been made for many years to bring alternative construction principles into practice, in particular for the roof and side wall assemblies.

Thus, from DE 196 19 212 A1 the coach body of a rail vehicle is known which substantially consists of horizontal and vertical panels, wherein the horizontal panels serve to form a floor and a roof and the vertical panels, in particular forming side walls, make it possible to install at least one window and one access door through corresponding apertures.

For the manufacture of the coach body, modules are used which are formed of fibre-reinforced plastic and which, in the section perpendicular to the longitudinal axis of the coach body, in each case form half-modules.

In each case two of these half-modules arranged complementary to each other and meeting in the middle across the vehicle form a longitudinal section.

The entire coach body consists of a plurality of in each case two half-modules which are connected to each other by suitable means. The half-modules particularly preferably have an inner wall and an outer wall which surround a core layer, wherein this is formed with good properties with respect to heat and sound insulation. The inner wall and the outer wall are preferably manufactured from fibre-reinforced plastic.

The fibre-reinforced plastics particularly preferably comprise glass, carbon, aramid and/or natural fibres. The plastics provided as matrix preferably comprise epoxy resins, unsaturated polyester resins, vinyl ester resins or phenolic resins.

A disadvantage of this design results from the size of the three-dimensionally formed modules. In addition, the adjoining module halves form a continuous butt joint in the area of the coach body floor and in the roof area, with the result that, in usual load situations in which the coach body is subjected to torsion, premature material fatigue must be expected in this joint area.

A body for a vehicle and a vehicle equipped with this body is known from GB 2 030 934 A.

The body there consists of modular part-segments which are connected to each other adjoining such that the segment modules at the same time form a portion of the body roof. For this, the part-segments have an angled extension.

In order to give the body the necessary strength, the individual modules are each installed in a superimposed form. Through the use of conventional construction materials, such as steel, signs of severe corrosion form in the overlap or joint area of the adjoining part-segments or segment modules. The prefabrication of the three-dimensionally shaped part-segments and of the profiles connecting them also requires high manufacturing accuracy.

During welding of the part-segments to each other, or to the profiles connecting them, comparatively large quantities of heat are introduced into the construction parts, which leads to more severe warping and to manufacturing inaccuracies resulting therefrom. Likewise, the structure is weakened due to the comparatively large heat affected zone. The undesired input of heat also regularly results in buckling or deformation of the thin-walled segment modules forming the outer skin of the coach body. These areas with the significant deformations must be laboriously re-worked through the further input of heat and the input of mechanical energy (normalizing, stress relieving, straightening). In addition, as a rule it is necessary to smooth and to grind the visible outer surfaces laboriously in order to give the coach body an attractive overall impression.

If the segment modules are connected to each other or to the adjoining profiles by screw or rivet connections, the danger of crevice corrosion in the connection zone is greatly increased thereby. As the connecting segments used and the segment modules additionally consist of different steels or steel alloys, the premature formation of contact corrosion can result.

A modular coach body in a lightweight design, which is conceived in particular for use in high-speed rail vehicles, is known from DE 10 2009 045 202 B4.

For this, the coach body for a passenger rail vehicle has several coach body modules closed around a longitudinal axis in the circumferential direction, wherein adjacent coach body modules are connected to each other through ring-shaped coupling modules that are closed in the circumferential direction. The coach body modules themselves are formed of several module elements which are connected to each other. The roof elements can be formed as flat elements and designed as a fibre composite plastic or sandwich element.

From EP 1 138 567 A2 it is known that a modular-constructed coach body of a rail vehicle is realized in a fibre composite design, wherein the coach body is formed of standardized modules, such as roof plate, top chord, window pillar, door post, side wall support, floor plate and stair module. The individual modules are as far as possible designed as a sandwich with a lost foam core. The roof plates here substantially consist of a foam core which is bordered on both sides by laminated fibre composite layers.

SUMMARY

The object is achieved according to the invention by a roof for a coach body according to independent claim 1. Advantageous designs of the invention are specified in the dependent claims.

According to the invention the roof segment is conceived for the construction of a roof of a coach body for a rail vehicle. The roof segment is preferably formed plate-, shell- or half-shell-shaped.

The roof segments of which the roof of a coach body for a rail vehicle is formed can preferably be connected to upper longitudinal beams.

The roof segment preferably consists of an outer wall and an inner wall spaced apart therefrom. Insulating properties such as sound and heat insulation are advantageously optimized thereby.

At least two roof segments are preferably designed such that the projecting area of the outer wall or inner wall of one roof segment is connected to the non-projecting area of the outer wall or inner wall of the adjacent roof segment in a positive-locking, friction-locking and/or material-bonded manner. Manufacturing tolerances can thereby advantageously be compensated for. Furthermore, a lower throughput time is thereby advantageously achieved, in that manufacturing teams for manufacturing the roof can install the roof segments along the longitudinal axis of the coach body from both ends of the coach body, i.e. from the outside inwards, without hindering each other.

The width of the roof segments preferably substantially corresponds to the width of the coach body. The stability of the coach body is thereby advantageously increased, in that no further filling materials or connecting elements are required. Alternatively, the width of the roof segments is smaller than the width of the coach body.

The roof segment preferably consists at least partially of fibre-reinforced plastic composite (FRP). Advantageously, the weight of the coach body is thereby considerably reduced with an unchanged stability, whereby the load capacity of the rail vehicle can again be increased. In particular in the case of underground railways, because of the predetermined train lengths and headways, significantly more people can be transported in the same time by increasing the load capacity.

A first aspect of the invention relates to the design of the roof segments which, connected to each other, form a structural flat roof of a coach body of a rail vehicle. The roof segments are preferably formed plate-shaped.

The individual roof segments of the roof of the coach body are formed as standard-type roof segments, heating-ventilation-air conditioning-type roof segments or end-type roof segments. The roof preferably includes in each case at least one standard-type roof segment, at least one heating-ventilation-air conditioning-type roof segment and at least one end-type roof segment.

The heating-ventilation-air conditioning-type roof segment preferably has at least one slot for an air conditioning unit.

At least one standard-type roof segment and at least one heating-ventilation-air conditioning-type roof segment are preferably arranged alternately in each case. Alternatively, at least two standard-type roof segments follow each other. In a further alternative embodiment, at least two heating-ventilation-air conditioning-type roof segments follow each other. In a further alternative embodiment, there are more standard-type roof segments than heating-ventilation-air conditioning-type roof segments. In a further alternative embodiment, there are more heating-ventilation-air conditioning-type roof segments than standard-type roof segments.

The roof of a coach body preferably comprises two end-type roof segments. The end-type roof segments represent the front and rear ends and thus the termination of the roof in the longitudinal direction of the coach.

The roof segments are preferably formed of FRP materials.

The roof segments preferably comprise at least an outer and an inner wall.

Within the meaning of the invention, by the outer wall is meant that surface which closes off the coach body towards the outside and which is in contact with the environment outside the coach body. Within the meaning of the invention, by the inner wall is meant that surface which is in contact with the coach body interior and thus the passenger area.

The inner and the outer wall of the roof segments are preferably formed parallel to each other and in each case of one or more plies of at least one FRP material.

The inner and the outer wall are preferably manufactured with a multiaxial fibre orientation, particularly preferably a bidirectional fibre orientation, quite particularly preferably in a 0°/90° orientation.

The fibres in the fibre-reinforced plastic composite of the roof segments are preferably introduced as roving and/or non-woven fabric and/or woven fabric and/or non-crimp fabric and/or meshwork.

Reinforcing elements are preferably arranged between the inner and the outer wall of the roof segments, wherein these are designed as rectangular hollow profiles.

The edges of the rectangular hollow profiles are preferably arranged parallel to the edges of the roof segments.

The rectangular hollow profiles are preferably produced from one or more plies of at least one FRP material.

The rectangular hollow profiles are preferably manufactured with a multiaxial fibre orientation, particularly preferably a bidirectional fibre orientation.

The rectangular hollow profiles preferably additionally have a core filling, formed as a foam and/or honeycomb and/or wood core. The wood core is preferably balsa wood. Furthermore, the core filling can also be formed of cork or as a fibrous insulating material. The core filling preferably serves to transmit weight and shear forces.

The rectangular hollow profiles are particularly preferably filled with a rigid foam.

A flat core material, formed as a foam and/or honeycomb and/or wood core, is preferably arranged between the rectangular hollow profiles between the inner and the outer wall of the roof segment in order to guarantee the structural strength and thus the walk-on stability.

The core material of a roof segment is preferably formed as a rigid foam sheet.

The individual roof segments are preferably produced in a pressing process, wherein the joining of the rectangular hollow profiles and optionally the flat core materials to either the inner or the outer wall of the roof segment is additionally effected by adhesive bonding.

The inner and the outer wall of a roof segment preferably have, in each case on at least one of their sides which is oriented perpendicular to the longitudinal axis of the coach body, called long side in the following, an area in which they project beyond the rectangular hollow profiles in such a way that a positive-locking connection can be produced between adjacent roof segments. This preferred embodiment advantageously allows individual roof segments to be joined to form the roof of the coach body analogously to methods known from the state of the art for floor coverings such as parquet or laminate (click parquet or click laminate). Particularly preferably, on one of the two long sides of an individual roof segment an area of the inner wall projects beyond the rectangular hollow profiles substantially over the entire longitudinal extent of the long side, and on the long side opposite this long side an area of the outer wall projects beyond the rectangular hollow profiles substantially over the entire longitudinal extent of the long side. Moreover, the joining of the individual roof segments to form the roof of the coach body is particularly preferably effected beginning with the end-type roof segments arranged on the two end areas of a coach body. In each case a next roof segment (standard-type or heating-ventilation-air conditioning-type roof segment) is arranged on these roof segments such that the area of the outer wall of the end-type roof segment, projecting beyond the rectangular hollow profiles, touches the outer wall of the next roof segment at least indirectly via a layer of an adhesive. Likewise, the area of the inner wall of the next roof segment, projecting beyond the rectangular hollow profiles, touches the inner wall of the end-type roof segment at least indirectly via a layer of an adhesive. In other words, the joining of the individual roof segments is effected beginning from the outside, thus the end areas of the coach body, inwards, thus towards the middle of the coach body. The roof segment which is arranged in the middle of the roof of the coach body is accordingly designed such that its outer wall does not have an area projecting beyond the rectangular hollow profiles, and its inner wall projects beyond the rectangular hollow profiles on both long sides of this roof segment. Moreover, adjacent rectangular hollow profiles of adjacent roof segments are particularly preferably connected to each other in a material-bonded manner, in particular by means of an adhesive, whereby advantageously, in addition to improved stability of the connection, it also becomes possible to compensate for manufacturing tolerances.

To realize the invention it is also expedient to combine the designs, embodiments and features of the claims according to the invention described above with each other in any order.

The invention is to be explained in more detail below with reference to an embodiment example. The embodiment example is intended to describe the invention without limiting it.

BRIEF DESCRIPTION OF THE DRAWINGS

The invention is explained in more detail with reference to drawings. There are shown in.

DETAILED DESCRIPTION

Figure 1:
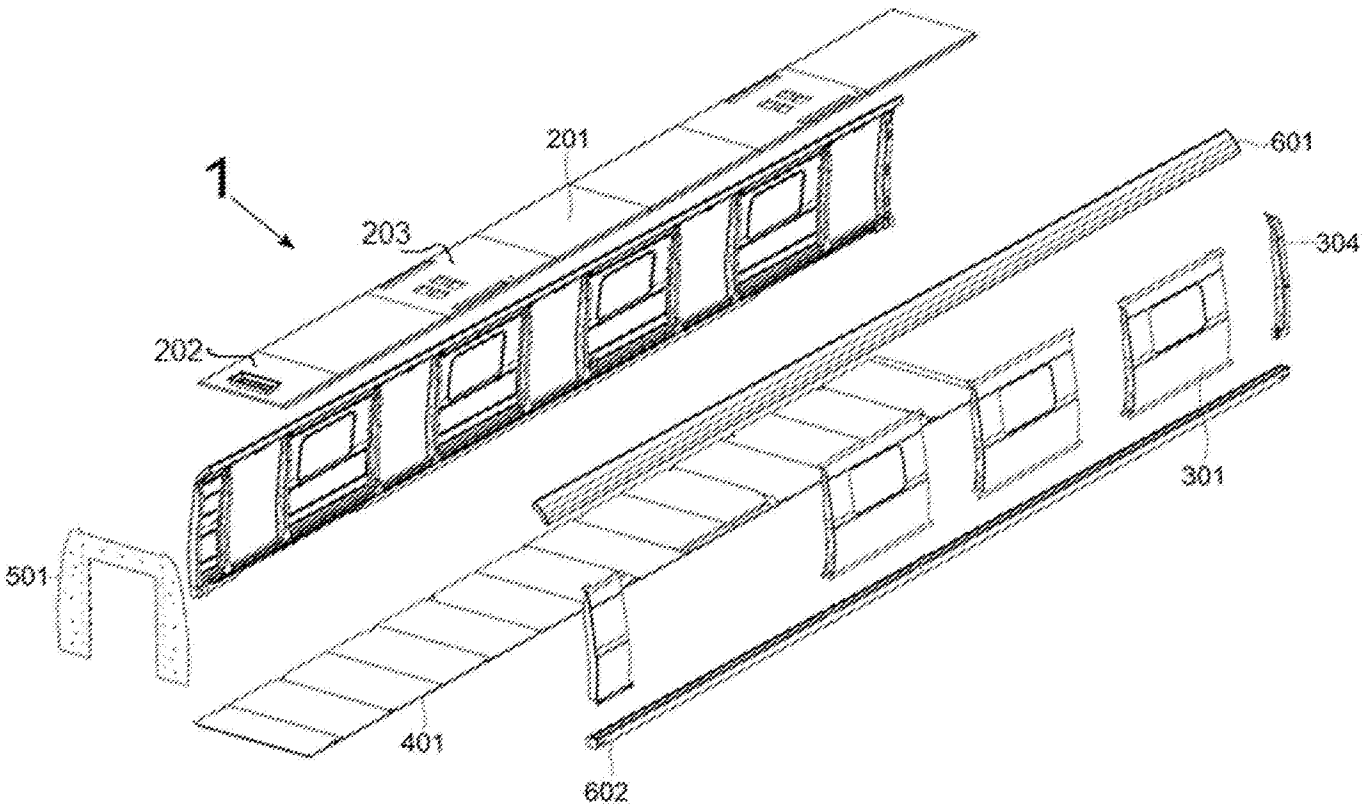
FIG. 1 exploded drawing of a coach body with the roof segments according to the invention, FIG. 2 standard-type roof segment of the coach body in an exploded perspective view and in a perspective view in the assembled state, FIG. 3 heating-ventilation-air conditioning-type roof segment of the coach body in an exploded perspective view, FIG. 4 end-type roof segment of the coach body in an exploded perspective view.

FIG. 1 shows an exploded drawing of a coach body 1 in which the roof segments according to the invention are installed as a standard-type roof segment 201, end-type roof segment 202 and heating-ventilation-air conditioning-type roof segment 203. Furthermore, the following components of the coach body are represented: the upper longitudinal beams 601 and the lower longitudinal beams 602, the side wall segments 301, the vertical pillars 304, the end wall 501 and the base segments 401.

Figure 2:
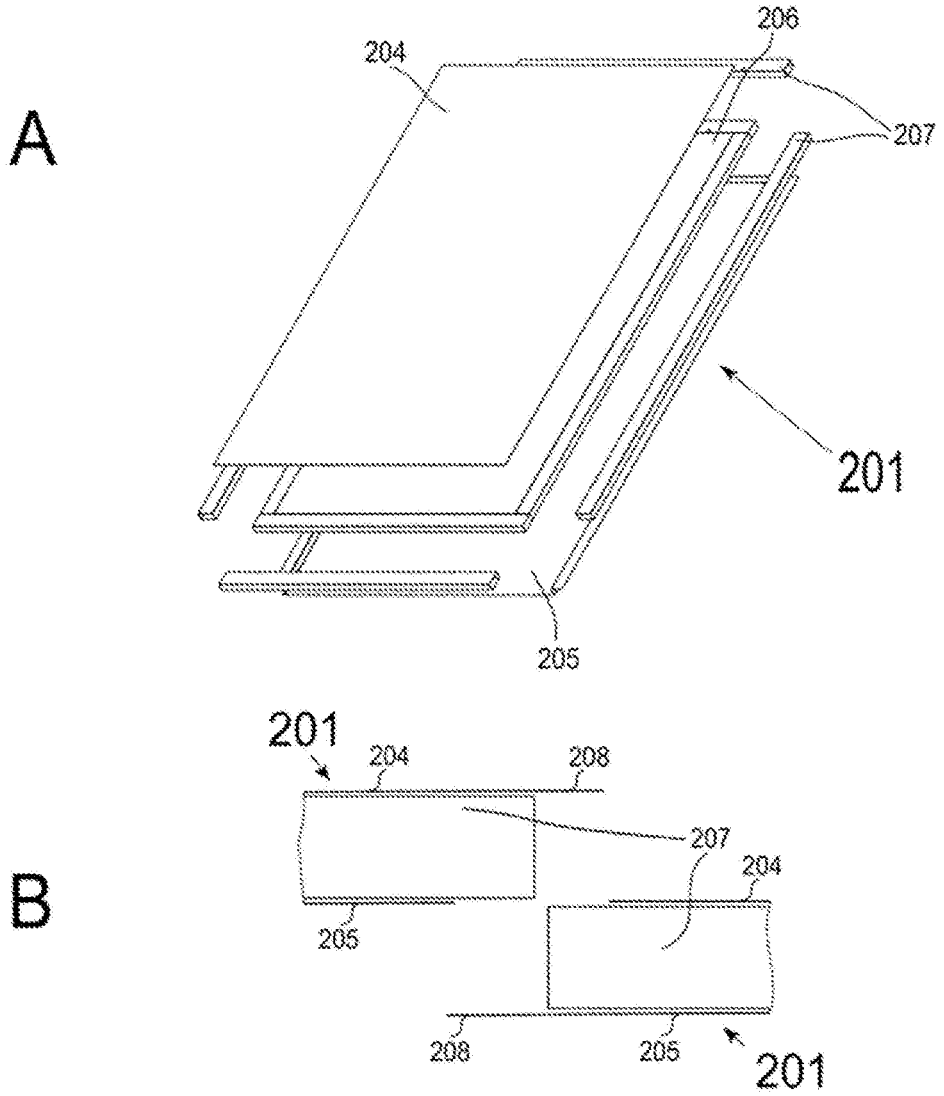

FIG. 2 shows a standard-type roof segment 201 of the coach body in an exploded perspective view (FIG. 2A) as well as a cross section through two adjacent standard-type roof segments 201 (FIG. 2B) during installation. The standard-type roof segment 201 is manufactured with an overall height of 50 mm. The standard-type roof segment 201 has an inner wall 205 and an outer wall 204, with an overall thickness of 1.0 mm and 2.0 mm respectively, and consisting of individual plies with a thickness of 0.5 mm and a weight per unit area of 400 g/m2. The carbon fibres are introduced into the plastic matrix made of epoxy resin in the form of a bidirectional non-crimp fabric and run in the 0° and 90° directions. Rectangular hollow profiles 207 are arranged, as reinforcing elements, between the inner wall 205 and the outer wall 204 of the standard-type roof segment 201 along the outer edges of the roof segment 201, and adhesively bonded to the outer wall 204. This is a conventional structural bonding with an adhesive gap of 0.25-0.40 mm. The rectangular hollow profiles 207 with a size of 100 mm×46.5 mm and a wall thickness of 1.5 mm are braided directly onto a PET rigid foam core in a braiding process (pullbraiding process), wherein the fibres have a fibre orientation in the ±45° direction and are embedded in a thermosetting matrix made of epoxy resin. A flat core material 206, formed as a PET rigid foam core made of Airex T90.60, is arranged between the inner wall 205 and the outer wall 204 and the frame made of rectangular hollow profiles filled with PET foam, and adhesively bonded to the outer wall 204. This is a conventional structural bonding with an adhesive gap of 0.25-0.40 mm. The completion of a standard-type roof segment 201 is effected in a pressing process in order to produce the connection to the inner wall 205 and to form the final shape of the standard-type roof segment 201 including the joints 208 for the connection to further roof segments (not represented). FIG. 2B illustrates the positive-locking connection between adjacent standard-type roof segments 201 via the joints 208 existing after the installation in addition to the material-bonded adhesive connection.

Figure 3:
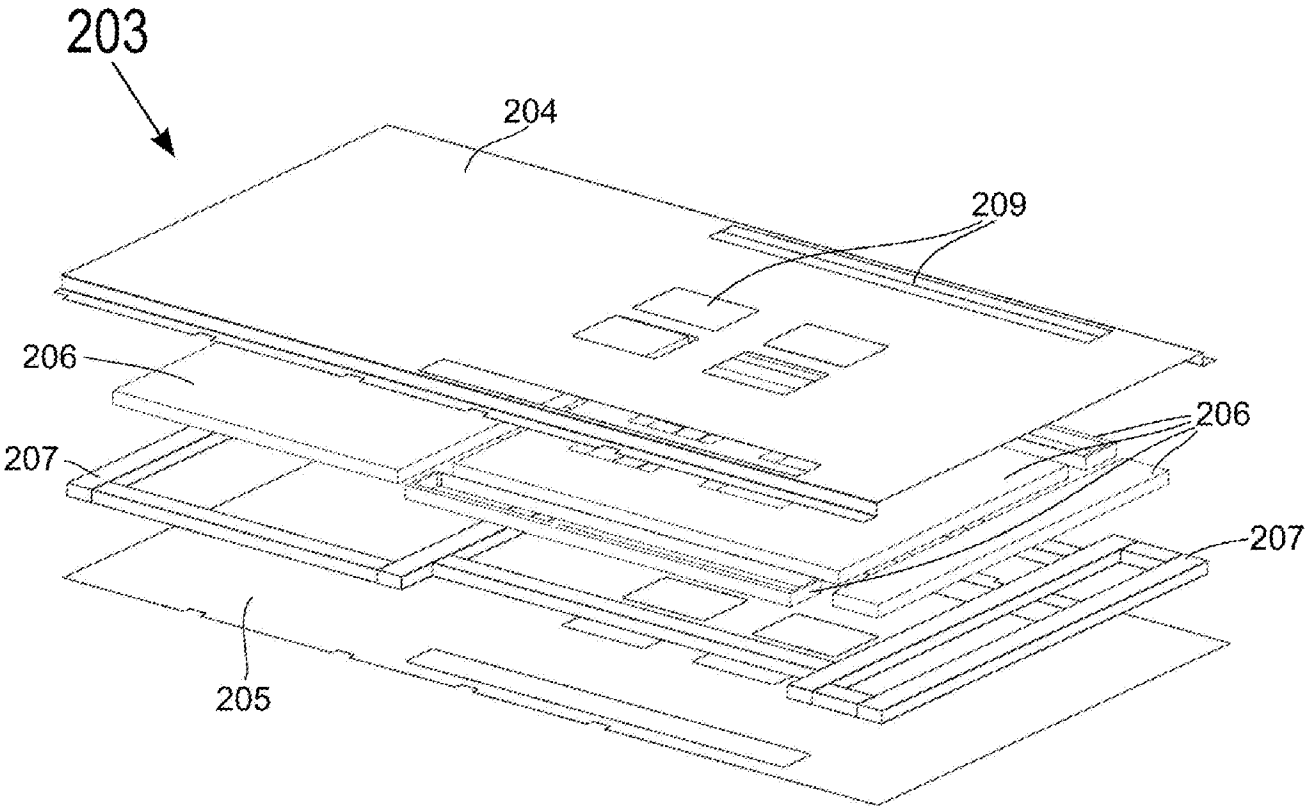

FIG. 3 shows a heating-ventilation-air conditioning roof segment 203 of the coach body in an exploded perspective view. The heating-ventilation-air conditioning roof segment 203 is manufactured with an overall height of 50 mm. The heating-ventilation-air conditioning roof segment 203 has an inner wall 205 and an outer wall 204, with an overall thickness of 1.0 mm and 2.0 mm respectively, and consisting of individual plies with a thickness of 0.5 mm and a weight per unit area of 400 g/m2. The carbon fibres are introduced into the plastic matrix made of epoxy resin in the form of a bidirectional non-crimp fabric and run in the 0° and 90° directions. Rectangular hollow profiles 207 are arranged, as reinforcing elements, between the inner wall 205 and the outer wall 204 of the heating-ventilation-air conditioning roof segment 203 along the outer edges of the heating-ventilation-air conditioning roof segment 203, and adhesively bonded to the outer wall 204. This is a conventional structural bonding with an adhesive gap of 0.25-0.40 mm. The rectangular hollow profiles 207 with a size of 100 mm×46.5 mm and a wall thickness of 1.5 mm are braided directly onto a PET rigid foam core in a braiding process (pullbraiding process), wherein the fibres have a fibre orientation in the ±45° direction and are embedded in a thermosetting matrix made of epoxy resin. A flat core material 206, formed as a PET rigid foam core made of Airex T90.60, is arranged between the inner wall 205 and the outer wall 204 and the frame made of rectangular hollow profiles 207 filled with PET foam, and adhesively bonded to the outer wall 204. This is a conventional structural bonding with an adhesive gap of 0.25-0.40 mm. The completion of a heating-ventilation-air conditioning roof segment 203 is effected in a pressing process in order to produce the connection to the inner wall 205 and to form the final shape of the heating-ventilation-air conditioning roof segment 203 including the joints 208 for the connection to further roof segments 203 (not represented). Furthermore, the heating-ventilation-air conditioning roof segment 203 comprises slots 209 which are each arranged uniformly in the inner wall 205, the outer wall 204 and the core material 206 and serve for ventilation.

Figure 4:
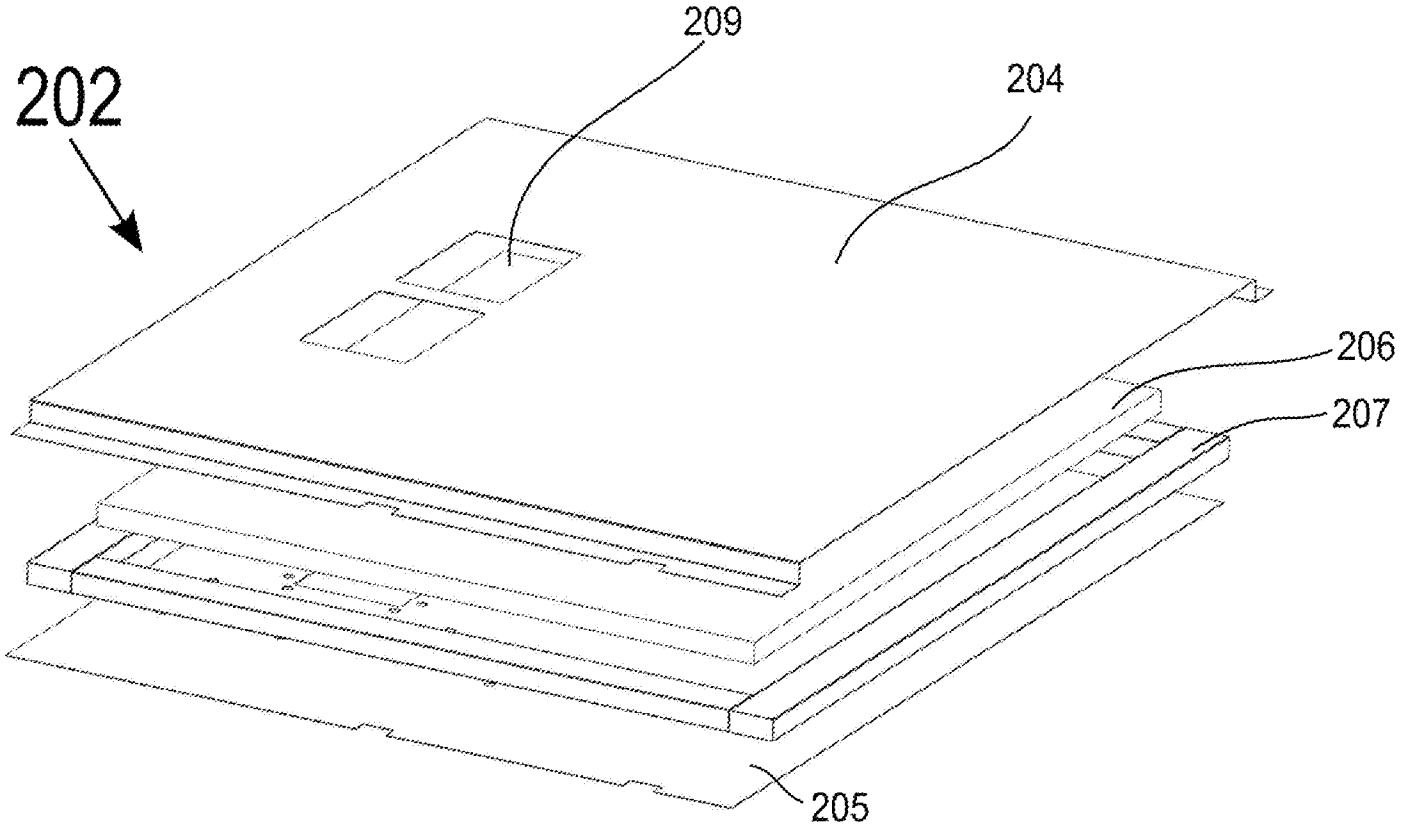

FIG. 4 shows an end-type roof segment 202 of the coach body in an exploded perspective view. The end-type roof segment 202 is manufactured with an overall height of 50 mm. The end-type roof segment 202 has an inner wall 205 and an outer wall 204, with an overall thickness of 1.0 mm and 2.0 mm respectively, and consisting of individual plies with a thickness of 0.5 mm and a weight per unit area of 400 g/m2. The carbon fibres are introduced into the plastic matrix made of epoxy resin in the form of a bidirectional non-crimp fabric and run in the 0° and 90° directions. Rectangular hollow profiles 207 are arranged, as reinforcing elements, between the inner wall 205 and the outer wall 204 of the end-type roof segment 202 along the outer edges of the end-type roof segment 202, and adhesively bonded to the outer wall 204. This is a conventional structural bonding with an adhesive gap of 0.25-0.40 mm. The rectangular hollow profiles 207 with a size of 100 mm×46.5 mm and a wall thickness of 1.5 mm are braided directly onto a PET rigid foam core in a braiding process (pullbraiding process), wherein the fibres have a fibre orientation in the ±45° direction and are embedded in a thermosetting matrix made of epoxy resin. A flat core material 206, formed as a PET rigid foam core made of Airex T90.60, is arranged between the inner wall 205 and the outer wall 204 and the frame made of rectangular hollow profiles filled with PET foam, and adhesively bonded to the outer wall. This is a conventional structural bonding with an adhesive gap of 0.25-0.40 mm. The completion of an end-type roof segment 202 is effected in a pressing process in order to produce the connection to the inner wall 205 and to form the final shape of the end-type roof segment 202 including the joints 208 for the connection to further roof segments 202 (not represented). Furthermore, the end-type roof segment 202 comprises slots 209 which are each arranged uniformly in the inner wall 205, the outer wall 204 and the core material 206 and serve for ventilation.

REFERENCE NUMBERS

1 coach body
201 standard-type roof segment
202 end-type roof segment
203 heating-ventilation-air conditioning-type roof segment
204 outer wall of the roof segment
205 inner wall of the roof segment
206 core material
207 rectangular hollow profiles
208 joint to adjoining roof segment
209 slot
301 side wall segment
304 vertical pillar
401 base segment
501 end wall
601 upper longitudinal beam
602 lower longitudinal beam

The invention claimed is:

1. Roof segment for the construction of a roof of a coach body for a rail vehicle, wherein the roof segment is formed plate-, shell- or half-shell-shaped, the roof segment consists of an outer wall and an inner wall spaced apart therefrom, and the outer wall and inner wall of the roof segments are connected by a middle layer, the outer wall and the inner wall, at two ends in a longitudinal direction of the coach body, of the roof segment are respectively extended beyond the middle layer or within the middle layer, and at least two roof segments are designed such that the projecting area of the outer wall of the one roof segment is connected to the non-projecting area of the outer wall of the adjacent roof segment and the projecting area of the inner wall of the one roof segment is connected to the non-projecting area of the inner wall of the adjacent roof segment in a positive-locking, friction-locking and/or material-bonded manner, and the roof segment consists at least partially of fibre-reinforced plastic composite, the roof segments of a coach body comprise at least two standard-type roof segments, at least two heating-ventilation-air conditioning-type roof segments and two end-type roof segments, each of the heating-ventilation-air conditioning roof segments comprises slots which are each arranged uniformly in the inner wall, the outer wall and the core material and serve for ventilation, each of the end-type roof segments comprises slots which are each arranged uniformly in the inner wall, the outer wall and the core material and serve for ventilation.

2. Roof segment according to claim 1, wherein the fibre-reinforced plastic composite comprises glass, carbon, aramid, basalt, textile and/or natural fibres in a matrix made of thermoplastics or thermosetting plastics.

3. Roof segment according to claim 2, wherein the thermosetting plastics comprise epoxy resins, unsaturated polyester resins, PU resins, vinyl ester resins or phenolic resins.

4. Roof segment according to claim 3, wherein the fibres of the fibre-reinforced plastic composite are oriented unidirectionally and/or multiaxially.

5. Roof segment according to claim 3, wherein the fibres of the fibre-reinforced plastic composite are introduced as rovings, non-woven fabrics, non-crimp fabrics, woven fabrics and/or meshwork.

6. Roof segment according to claim 2, wherein the thermosetting plastics comprise epoxy resins, unsaturated polyester resins, PU resins, vinyl ester resins or phenolic resins.

7. Roof segment according to claim 2, wherein the fibres of the fibre-reinforced plastic composite are oriented unidirectionally and/or multiaxially.

8. Roof segment according to claim 2, wherein the fibres of the fibre-reinforced plastic composite are introduced as rovings, non-woven fabrics, non-crimp fabrics, woven fabrics and/or meshwork.

9. Roof segment according to claim 1, wherein the fibres of the fibre-reinforced plastic composite are oriented unidirectionally and/or multiaxially.

10. Roof segment according to claim 9, wherein the fibres of the fibre-reinforced plastic composite are introduced as rovings, non-woven fabrics, non-crimp fabrics, woven fabrics and/or meshwork.

11. Roof segment according to claim 1, wherein the fibres of the fibre-reinforced plastic composite are introduced as rovings, non-woven fabrics, non-crimp fabrics, woven fabrics and/or meshwork.

12. Roof segment according to claim 1, wherein the middle layer has a foam core and/or honeycomb core and/or wood core.

13. Roof segment according to claim 1, wherein the middle layer, as a fibre-reinforced plastic composite which is formed of one or more plies, connects the inner and the outer wall, and formed cavities are filled with foam and/or honeycomb cores and/or wood cores.

14. Roof segment according to claim 1, wherein the plate-, shell- or half-shell-shaped roof segments are connected to an upper longitudinal beam in a friction- and/or positive-locking and/or material-bonded manner.

15. Use of the roof segments according to claim 1 for the construction of a roof for the coach body of a rail vehicle for transporting passengers for use in underground and suburban railways, in which the rail vehicles or the train units formed of the roof segments are speeded up and slowed down.

* * * * *